US007587312B2

(12) United States Patent
Kim

(10) Patent No.: US 7,587,312 B2
(45) Date of Patent: Sep. 8, 2009

(54) METHOD AND APPARATUS FOR PITCH MODULATION AND GENDER IDENTIFICATION OF A VOICE SIGNAL

(75) Inventor: Ki Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 914 days.

(21) Appl. No.: 10/746,522

(22) Filed: Dec. 24, 2003

(65) Prior Publication Data

US 2004/0138879 A1 Jul. 15, 2004

(30) Foreign Application Priority Data

Dec. 27, 2002 (KR) ..... 10-2002-0085368

(51) Int. Cl.
*G10L 11/04* (2006.01)

(52) U.S. Cl. ..... 704/205; 704/206; 704/207

(58) Field of Classification Search ..... 704/205–207
See application file for complete search history.

(56) References Cited

U.S. PATENT DOCUMENTS 5,577,160 A * 11/1996 Hosom et al. ..... 704/209
5,774,837 A * 6/1998 Yeldener et al. ..... 704/208
5,933,801 A * 8/1999 Fink et al. ..... 704/208
6,275,806 B1 * 8/2001 Pertrushin ..... 704/272
6,615,174 B1 * 9/2003 Arslan et al. ..... 704/270
7,016,833 B2 * 3/2006 Gable et al. ..... 704/209
7,228,273 B2 * 6/2007 Okunoki ..... 704/270

FOREIGN PATENT DOCUMENTS

JP 2000-163097 6/2000

* cited by examiner

*Primary Examiner*—Michael N Opsasnick
(74) *Attorney, Agent, or Firm*—Lee, Hong, Degerman, Kang & Waimey

(57) ABSTRACT

A method and apparatus for modulating pitch and identifying gender of a voice signal is provided. The voice modulation apparatus includes an LPC analyzer for obtaining vocal track filter coefficients reflecting characteristics of an input voice signal, a pitch detector for detecting the pitch and the gender of the voice signal, a pitch modulator for modulating the voice signal by applying a predetermined value to a detected value from the pitch detector, and a coder for coding the input signal from to LPC analyzer and to pitch modulator, and for outputting a coded signal.

17 Claims, 5 Drawing Sheets

METHOD AND APPARATUS FOR PITCH MODULATION AND GENDER IDENTIFICATION OF A VOICE SIGNAL

CROSS-REFERENCE TO RELATED APPLICATIONS

Pursuant to 35 U.S.C. § 119(a), this application claims the benefit of earlier filing date and right of priority to Korean Application No. 85368/2002, filed on Dec. 27, 2002, the contents of which are hereby incorporated by reference herein in their entirety.

BACKGROUND OF THE INVENTION

1. Field of the Invention

The present invention relates to a voice modulation apparatus and method in a voice telecommunication apparatus such as wired/wireless telephone.

2. Discussion of the Background Art

In general, a telephone is an instrument for voice telecommunication between two parties at a distance by wire or wirelessly, and the most basic form of communication in a modern society.

In recent years, with the development of mobile communication network technology, the popularity of wireless telephones, namely mobile communication terminals, has rapidly increased.

The mobile communication terminal has increased its role from voice transmission to data transmission/receiving, exchanging character (text) messages, providing services like weather forecast, stock transactions, money deposit or withdrawal, breaking news, and e-mail remote meter reading.

Besides the character (text) message service, multimedia message service (MMS) is now available through the mobile communication terminal also.

The multimedia messages include still images, voice messages, voice mails, and moving images using MPEG4.

Therefore, many application technologies for the mobile communication terminal that supports the multimedia message service are being developed in a steady stream. For example, in case of sending a still image, a user can add different effects to the still image by making the image blank and white or by inverting the image.

However, there are not many application programs developed for the voice messages except a voice mailbox, and the above special effects are hardly used.

When a caller wants to send a voice message or a voice mail to the other party, a vocoder converts the voice to appropriate digital signals for transmission.

Typically used voice coders for the telephone are AMR (Adaptive Multi Rate), EVRC (Enhanced Variable Rate Coder), QCELP (Qualcomm Code Excited Linear Predictive Coding) and so forth. On the whole, the voice coders can be divided into three types: source coder using a voice model, waveform coder, and hybrid coder, which is a combination of the source coder and the waveform coder.

The source coder analyzes a voice (or speech) model instead of a waveform of the voice, and modulates the analyzed data.

The source coder includes a LPC source vocoder, a channel source vocoder, a format source vocoder, a phase source vocoder etc.

The source coder extracts a characteristic parameter from a voice signal based on the generation model of a voice signal, and a decoder regenerates the voice using the characteristic parameter.

In other words, the source coder presents voice signals by modeling a human voice generation process. It does not regenerate a waveform of the voice signal, but regenerates sound that is as close as an original voice signal possible to a human's ear.

The source coder utilizes a voice coder with a low transmission rate usually around 4.8-13.2 Kbps.

A typically used voice coder is a LPC (Linear Predictive Coding).

On the other hand, the waveform coder, like PCM, modulates a voice waveform. Its primary objective is to ensure that a restored signal at a data sink conserves the pattern of an original signal from a data source.

Accordingly, the waveform coder is applicable not only to voice signals, but also to other size-limited signals (e.g., PSK (Phase Shift Keying) signals used in PC communication).

For the same reason, a waveform coder usually operates in a single sampling unit, and an objective scale like SNR can measure function of the waveform coder.

Examples of the waveform coder include PCM (Pulse Code Modulation), DM (Delta Modulation), APCM (Adaptive PCM), DPCM Difference PCM), ADPCM (Adaptive Difference PCM) and so on.

The first commercially used voice coder was 64 Kbps PCM that was accepted as an international standard back in 1972. This coder is still widely used in many digital systems especially telephones in general. Twelve years later, in 1984, 32 Kbps ADPCM replaced the 64 Kbps PCM. Compared to the 64 Kbps PCM, the 32 Kbps ADPCM has a lower transmission rate, and thus it is often used as criteria for voice quality of a low transmission rate-coder.

A problem with the waveform coder is that voice quality is severely degraded below 16 Kbps. However, since the waveform can be simply realized relatively and was performed with little computation, the waveform coder still has applications in many diverse fields.

Lastly, the hybrid coder, which has only advantages of the waveform coder and the source coder, codes a difference between an original sound and a restored sound.

The hybrid coder converts a voice signal to a digital PCM, and a vocoder extracts only characteristics of the voice with 64 Kbps PCM.

Therefore, the hybrid coder can maintain superior voice quality even at a low transmission rate around 8 Kbps.

In accordance with modeling of an error signal, the hybrid coder can be divided into RELP (Residual Excited Linear Prediction), MPLPC (Multi-Pulse LPC), CELP (Code Excited Linear Prediction), VSELP (Vector Sum Excited Linear Prediction), RPE-LTP (Regular Pulse Excited-Long Term Prediction), and IMBE (Improved Multi-Band Excitation).

The hybrid coder codes an error signal between the original sound and the restored signal and transmits the coded signal. To this end, vector quantization is employed.

The vector quantization process finds the codebook index which has minimum mean square error between the original signal and reconstructed signal, and transmits an index in order to get a compression effect therefrom.

FIG. 1 is a block diagram of a related general voice codec and transmission system.

Generally, voice is largely divided into voiced sounds and unvoiced sounds, depending on whether or not vocal cords vibrate.

The voiced sounds are generated when airflow with a period set by vibration of the vocal cords passes a vocal track that oscillates between glottis and lips. The unvoiced sounds are generated by forming a construction at some point along the vocal tract and forcing air through the constriction to produce turbulence, in the absence of vibration of the vocal cords.

When a person speaks, the physical shape of the vocal track changes by time. Thus, voice signals are nonstationary.

An example of voice generation model utilizes a time-varying digital filter to show characteristics of the vocal track, and depending on whether sound is voiced or unvoiced, excites an input signal to a periodic impulse train or white noise element.

Referring to FIG. 1, the voice transmission system in which a user transmits his or her voice to the other party using a voice communication apparatus includes an LPC (Linear Predictive Coding) analysis 100 to which a voice signal illustrated in FIG. 3 is input, a pitch detector 110, a coder 120, a decoder 130, and an LPC synthesizer 140.

To decode the voice signal, the voice transmission system represents the voice signal in terms of pitch and envelope before transmission.

The LPC analyzer 100 to which the voice signal is input obtains a filter factor that features envelope characteristics of voice spectrum.

The pitch detector 110 distinguishes whether the voice signal is voiced or unvoiced, and when the voice signal is voiced, the pitch is selected as an input signal but when the voice signal is unvoiced, the white noise is selected as an input signal.

The coder 120 codes the voice signal, based on the filter factor and the variable obtained from the LPC analyzer 100 and the pitch detector 110, and transmits the signal to the other party through a channel via a wire or wirelessly.

The decoder 130 demuxes a transmitted stream through the channel, and decodes the stream.

The LPC synthesizer 140 synthesizes the decoded voice stream to voice, and outputs the synthesized voice.

The related art voice coder with the above organization simply serves to amplify an analog voice signal, or to convert the analog voice signal to a digital signal, and enables to exchange the signal through interface via a wire or wirelessly. Its primary role is found in minimizing sound distortion and noises, and thus restoring an original sound as much as possible.

However, considering that most of people now use telephones very often, simply exchanging one's voice is not sufficient to meet diverse demands of users.

For example, as the image of a current society to women is very dangerous and insecure, they often want to answer a phone in a male voice especially when they are home alone.

Also, there are people who want to create voice messages or voice mails using a different voice from theirs, hoping their callers to enjoy the messages.

SUMMARY OF THE INVENTION

An object of the invention is to solve at least the above problems and/or disadvantages and to provide at least the advantages described hereinafter.

Accordingly, one object of the present invention is to solve the foregoing problems by providing a voice modulation apparatus and method, capable of changing voice pitch of a user when the user wants to transmit a voice message or a voice mail using a voice communication apparatus, thereby protecting the user's privacy.

The foregoing and other objects and advantages are realized by providing a voice modulation apparatus including: an LPC analyzer for obtaining a vocal track filter coefficients reflecting characteristics of an input voice signal; a pitch detector for detecting pitch and gender of the voice signal; a pitch modulator for modulating the voice signal by applying a predetermined value to a detected value from the pitch detector; and a coder for coding the input signal from the LPC analyzer and the pitch modulator and for outputting a coded signal.

In a preferred embodiment, the pitch detector includes a gender detector for identifying gender of the input voice signal, based on pitch and/or frequency of the input voice signal.

In a preferred embodiment, the pitch detector comprises a memory for storing a multiplication of the pitch value outputted from the pitch detector by a predetermined value; and a multiplier for multiplying a value outputted from the memory by a value outputted from the pitch detector.

In a preferred embodiment, the memory stores at least two values for use in varying a signal outputted from the pitch detector.

Another aspect of the invention provides a voice modulation method, including the steps of: analyzing an input voice signal from a user and detecting voice pitch thereof; deciding whether the user chooses a voice modulation function; when the user chooses the voice modulation function, varying a pitch period of the voice signal and modulating the voice pitch; and coding the input signal and outputting a coded signal.

Another aspect of the invention provides a voice modulation method, including the steps of: in a pitch detector, detecting gender and pitch of an input signal; in a pitch modulator, multiplying the detected value by a predetermined value for voice modulation; in a coder, converting an outputted value of the pitch modulator and outputting a coded value.

The voice modulation method further includes the step of: storing in a memory at least two weighting coefficients in consideration of an input voice and an output voice.

When the present invention is adapted to a voice communication apparatus, voice pitch of the user can be varied as desired. Thus, a user can transmit to the other party a voice mail or a voice message in his or her own voice as well as in a different voice whatever he or she wants. Therefore, the present invention can be advantageously used for satisfying diverse demands.

In addition, the present invention can also be adapted to an MMS-supported voice communication apparatus, under IMT-2000 service, thereby providing a caller ID function using the caller's voice and thus, protecting the call receiver's privacy.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a voice modulation apparatus and method according to a preferred embodiment of the invention in reference to the accompanying drawings.

Figure 1:
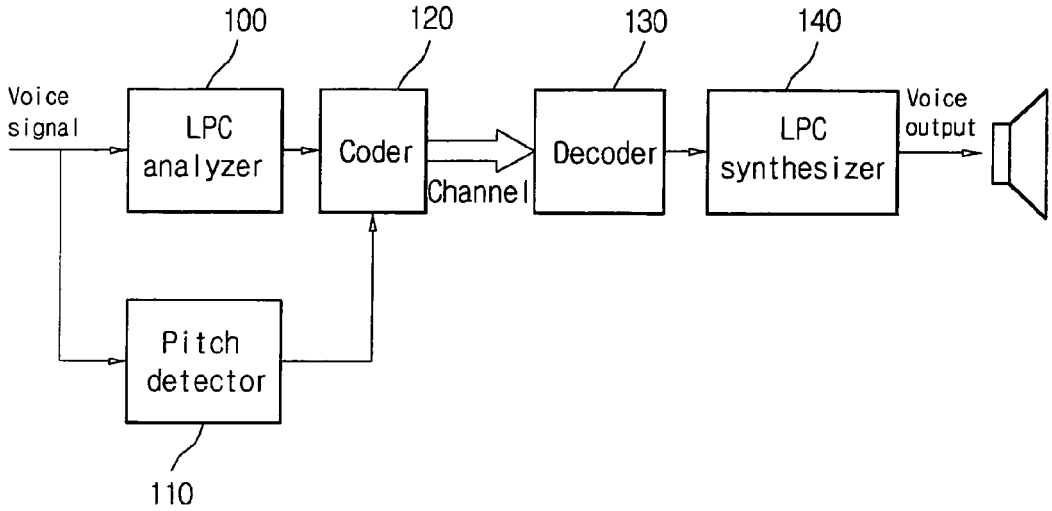
FIG. 1 Related Art
FIG. 1 is a block diagram of a related general voice codec and transmission system.
Figure 2:
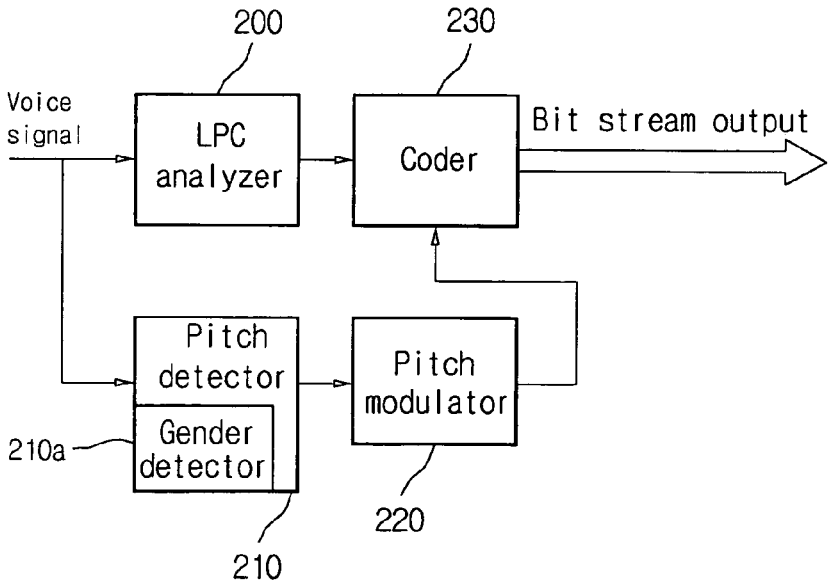
FIG. 2 is a block diagram illustrating an organization of a voice modulation apparatus according to the present invention.

FIG. 2 is a block diagram illustrating an organization of a voice modulation apparatus according to the present invention.

As illustrated in FIG. 2, the voice modulation apparatus illustrated includes an LPC analyzer 200, a pitch detector 210, a pitch modulator 220, and a coder 230.

Inside of the pitch detector 210 is a gender detector 210*a* for distinguishing gender using frequency or pitch of an input voice signal.

Further, the pitch modulator 220 includes a memory 220*a* (shown in FIG. 3) that stores predetermined value for multiplication of a pitch value outputted from the pitch detector 210, and a multiplier that multiplies an output value from the memory by an output value from the pitch detector 210.

Figure 3:
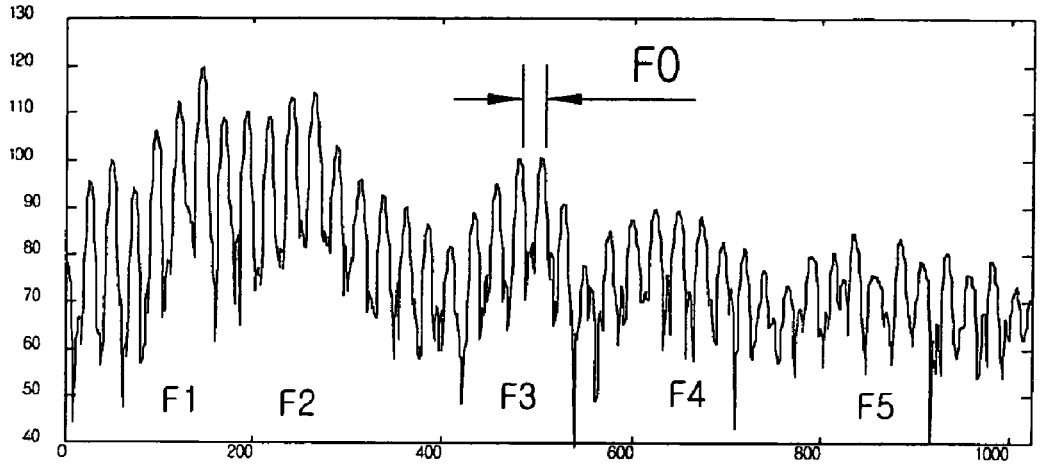
FIG. 3 shows frequency spectrum and pitch of an input voice signal (voiced sound)

FIG. 3 shows frequency spectrum and pitch of an input voiced signal to the LPC analyzer 200 and the pitch detector 210.

In FIG. 3, F0 indicates a fundamental frequency, and F1, F2, F3 and F4 indicate formant frequencies. Using these elements, the apparatus can identify voices.

Here, 'formant frequencies' mean resonant frequencies of a vocal track filter.

Figure 4:
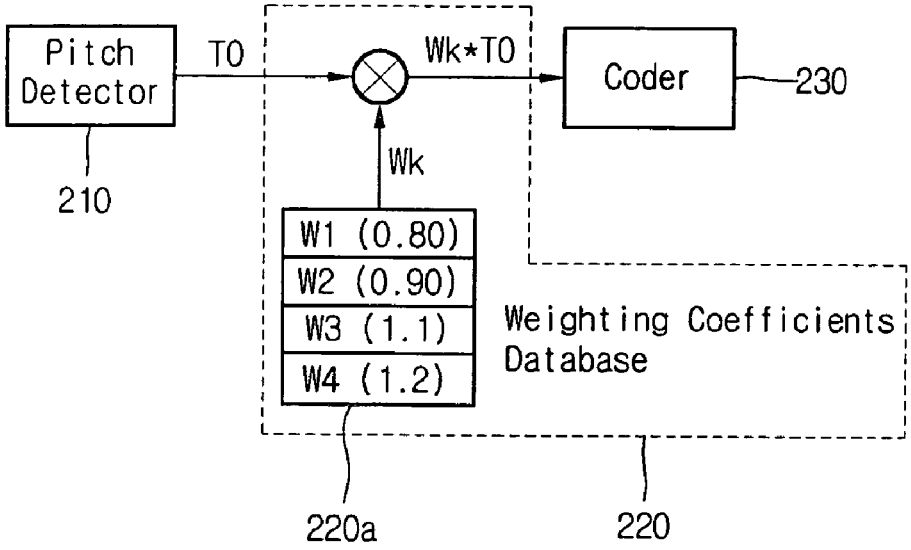
FIG. 4 is a schematic block diagram of a pitch modulator and peripheral devices thereof.

FIG. 4 is a schematic block diagram of a pitch modulator and peripheral devices thereof. Internal organization of the pitch modulator is same as the above.

The pitch modulator converts voice pitch of a user (i.e. speaker) provided by the pitch detector to a desired voice pitch. This is achieved by multiplying a pitch value of an original voice signal by weighting coefficients.

Predetermined weighting coefficients are stored in a database.

More specifically, the database of weighting coefficients has predetermined values ranging from 0.8 to 1.2, and when the user selects a particular value, the selected value is multiplied by T0 (original signal) and stored in a stream format of the voice coder for transmission.

The weighting coefficients are carefully determined in consideration of a desired output voice out of an input voice.

For instance, different weighting coefficients are applied to different cases, that is, modulation of a female voice to a different female voice or a male voice and modulation of a male voice to a different male voice or a female voice.

The weighting coefficients for voice modulation are designated to be greater when a modulated voice being outputted is of a male rather than of a female.

Figure 5A:
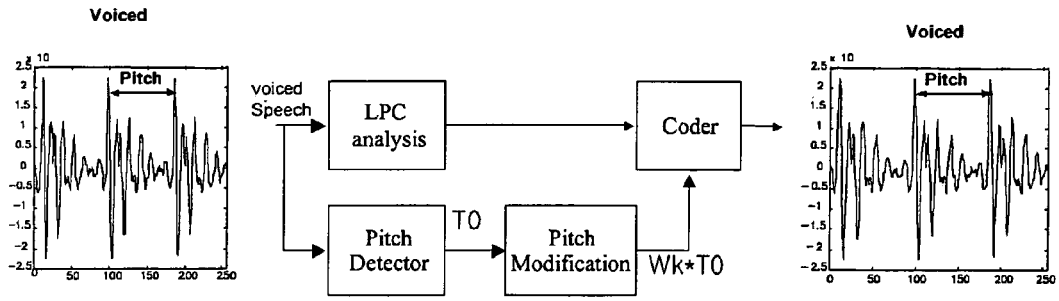
FIGS. 5*a* and 5*b* illustrate exemplary embodiments of pitch modulator according to the present invention.

FIG. 5*a* illustrates one embodiment of pitch modulator according to the present invention, in which a female voice pitch is modulated through multiplication by a weighting coefficient to a different female voice pitch or a male voice pitch.

As shown in FIG. 5*a*, when an input signal is voiced, voice pitch is detected, and a corresponding weighting coefficient is multiplied for voice modulation. On the other hand, when an input signal is unvoiced, the input signal is outputted as is without any voice modulation.

Figure 5B:
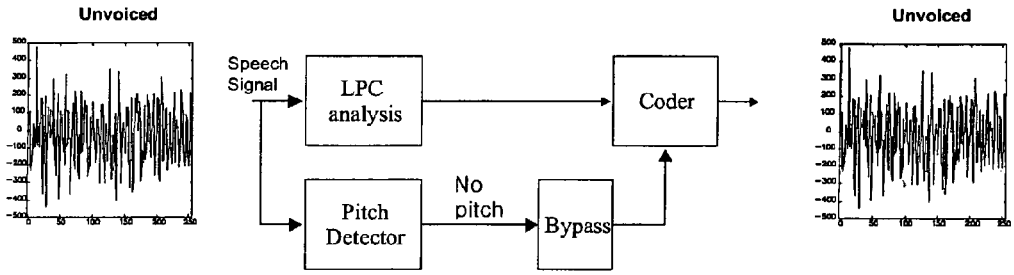
Figure 6:
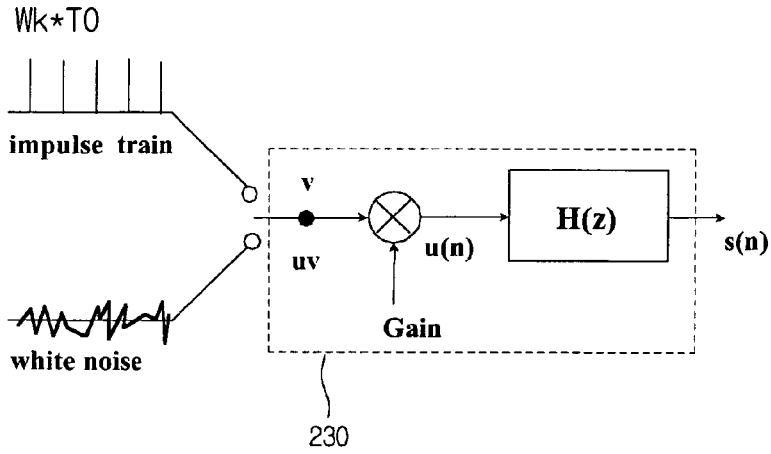
FIG. 6 illustrates a state in which a modulated voiced signal in FIG. 5*a* or an unvoiced signal without modulation in FIG. 5*b* is input to a coder.

FIG. 6 illustrates a state in which a modulated voiced signal in FIG. 5*a* or an unvoiced signal without modulation in FIG. 5*b* is input to a coder.

As shown in FIG. 6, there are two types of elements to be input to the coder: one is an impulse train which is a multiplication of an output value (T0) of the pitch detector by a weighting coefficient ($W_K$) stored in the database of the memory, and the other is an white noise which bypassed the pitch modulator.

Further, FIG. 6 shows an internal organization of the coder 230.

Figure 7:
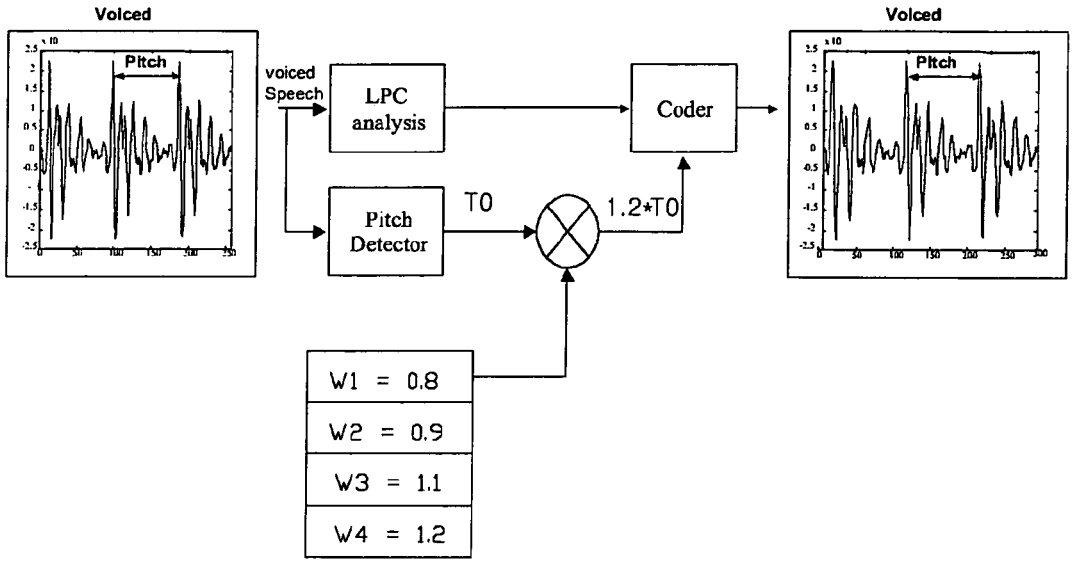
FIG. 7 illustrates another exemplary embodiment of pitch modulator according to the present invention.

FIG. 7 illustrates another exemplary embodiment of pitch modulator according to the present invention, in which a female voice is modulated to a male voice.

As shown in FIG. 7, when an input signal is voiced, voice pitch (T0) of the input signal is detected and multiplied by a corresponding weighting coefficient for voice modulation.

Figure 8:
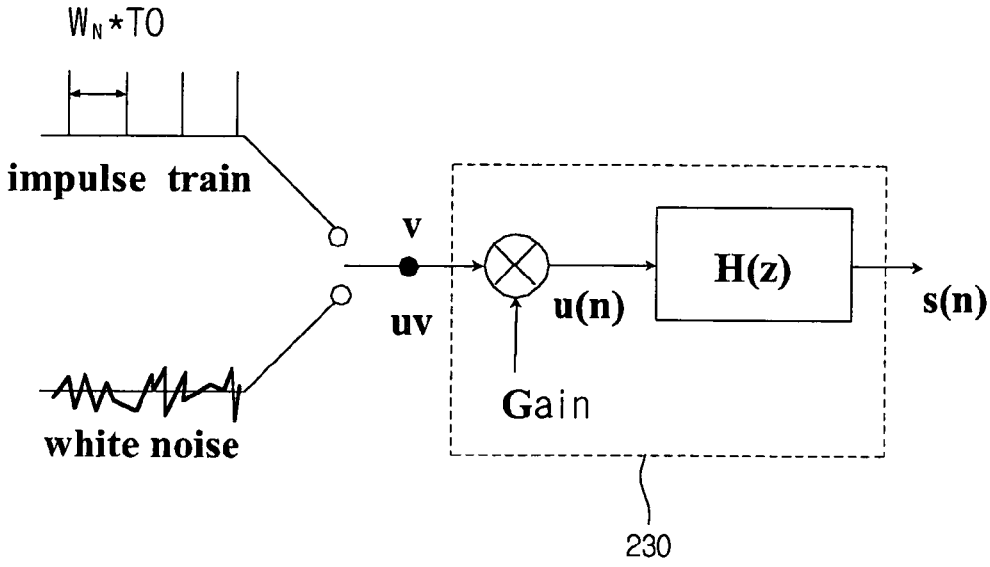
FIG. 8 illustrates a state in which a modulated voice signal in FIG. 7 is input to a coder.

FIG. 8 illustrates a state in which a modulated voice signal in FIG. 7 or an unmodulated voice signal is input to a coder.

As depicted in FIG. 8, two types of elements are input to the coder. One is an impulse train which is a multiplication of an output value (T0) of the pitch detector by a weighting coefficient ($W_N$) stored in the database of the memory, and the other is an white noise which bypassed the pitch modulator An operation of the voice modulation apparatus is now described with reference to the respective drawings.

As shown in FIG. 3, an input voice signal passes through the LPC analyzer 200 and the pitch detector 210 in FIG. 2.

From the LPC analyzer 200 to which the voice signal is input is obtained filter coefficients that represent envelope characteristics of voice spectrum.

The LPC analyzer 200 obtains the filter coefficients representing envelope characteristics of the voice spectrum, based on LPC that predicts a present signal from old signals.

The pitch detector 210 including the gender detector 210*a* distinguishes whether the voice signal is voiced or unvoiced. As shown in FIG. 6 and FIG. 8, when the input voice signal is voiced, voice pitch is selected as an input signal to the voice modulation while when the input voice signal is unvoiced, white noise is selected as an input signal to the pitch modulator.

Based on frequency or pitch of the input signal, it is found out whether the speaker is male or female.

Regarding the voiced sound generation, an excitation signal can be a modulated airflow caused by vibration of the vocal cords.

The excitation signal is periodic in accordance with a pitch period, and a spectrum thereof shows harmonics of periodic signals.

Regarding the unvoiced sound generation, a construction is formed at some point along the vocal tract and air is forced through the constriction to produce turbulence to produce an excitation signal. This excitation signal is similar to noises in its nature.

Pitch of the voiced sound is presented as an impulse train. A period of the impulse train is called a pitch, which shows high and low of a sound.

A difference between a male voice and a female voice is also generated by a harmonic frequency difference of the pitch.

The pitch modulator 220 varies the input voice pitch from the pitch detector 210, using the pitch period. The coder 230 codes the modulated voice by applying the variables obtained from the LPC analyzer 200 and the pitch modulator 220, and finally outputs a bit stream.

The above modulation procedure is applied when the user chooses a voice modulation function. If the user does not choose the voice modulation function, the voice signal is coded without being modulated.

The coded voice signal followed by the modulation procedure is then transmitted to the other party via a wired channel or wirelessly.

A voice communication apparatus of the other party includes a decoder and an LPC synthesizer. The decoder demuxes a transmitted stream through a channel and finds a transmitted variable, and using the variable, the LPC synthesizer synthesizes a caller's voice and outputs the synthesized voice.

An operation of the above voice modulation apparatus is discussed below using an example.

As shown in FIG. 7, suppose that a young female user inputs her voice in her mobile communication terminal to send a voice mail to her friend, and chooses the voice modulation function for modulation to a male voice.

The young female voice has a periodic voiced speech, and the pitch period of the voiced speech becomes voice pitch of the young female.

As for the female voice, an outputted value (variable) from the pitch detector is multiplied by a corresponding weighting coefficient, resulting in an impulse train element as shown in FIG. 8.

Then, a voice mail with the modulated young female voice is transmitted to the other party, and what the young female's friend hears then is a male voice as the caller desired.

Figure 9:
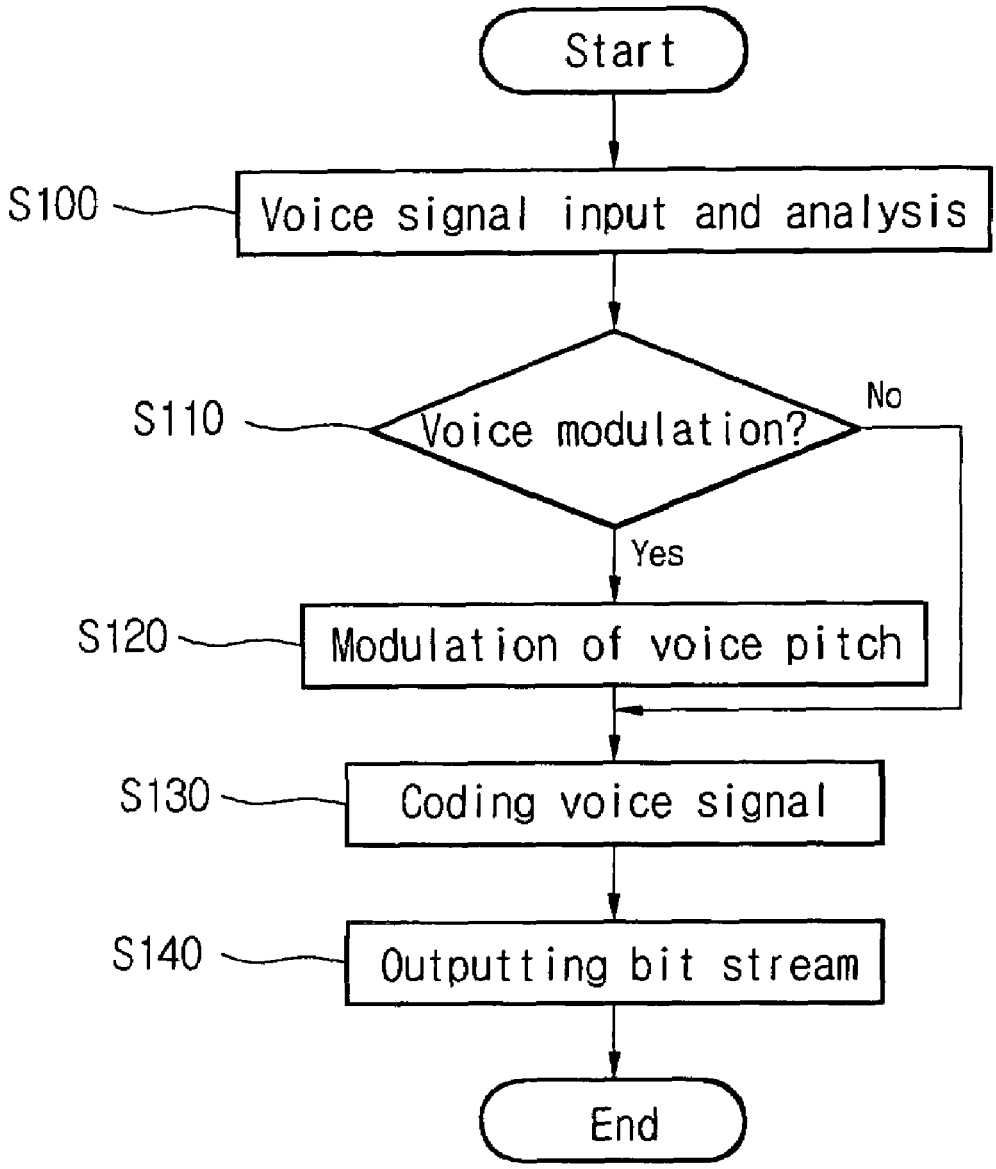
FIG. 9 is a flow chart of a voice modulation method according to the present invention.

FIG. 9 is a flow chart of a voice modulation method according to the present invention.

When a voice signal of a user is input, the voice signal is analyzed through LPC analyzer and auto correlation, being divided into voice pitch and vocal track filter parameter reflecting envelope characteristics (S100).

It is decided whether the user chooses a voice modulation function (S110), and if so, the voice pitch is modulated as the user desired (S120).

The voice modulation is possible by varying the period of an impulse train of the voice signal. That is to say, an outputted value (variable) from the pitch detector is multiplied by a predetermined weighting coefficient for voice modulation.

After the voice modulation, the voice is processed. The voice processing involves coding the modulated voice (S130), and outputting a bit stream from the coded voice (S140). The outputted bit stream is then transmitted via a channel, is decoded and goes through the LPC synthesis process before being outputted to the other party.

However, when the user does not choose the voice modulation function, the user's voice is not modulated but the user's voice signal is coded (S130). Again, a bit stream is outputted from the coded voice signal and transmitted to the other party via a channel (S140).

In conclusion, when the present invention is adapted to a voice communication apparatus, voice pitch of the user can be varied as desired. Thus, the user can transmit to the other party a voice mail or a voice message in his or her own voice as well as in a different voice whatever he or she wants. Therefore, the present invention can be advantageously used for satisfying diverse demands.

In addition, the present invention can also be adapted to an MMS-supported voice communication apparatus, under IMT-2000 service, thereby providing a caller ID function using the caller's voice and thus, protecting the call receiver's privacy.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A voice modulation apparatus, comprising:

an LPC (linear predictive coding) analyzer for obtaining vocal track filter coefficients reflecting characteristics of an input voice signal;

a pitch detector for detecting pitch value and gender of the voice signal, wherein the pitch detector comprises a gender detector for identifying gender of the input voice signal, based on at least one of pitch or frequency of the input voice signal;

a pitch modulator for modulating the voice signal by multiplying a predetermined value output from a memory by a detected value output from the pitch detector, wherein the voice signal is modulated differently by multiplying a different predetermined value by the detected value output from the pitch detector, wherein the different predetermined value varies according to the identified gender; and a coder for coding the a signal from the LPC analyzer and a signal from the pitch modulator and for outputting a coded signal.

2. The method according to claim 1, wherein the voice signal is modulated according to gender and wherein the predetermined value is selected according to a desired gender modulation.

3. The method according to claim 1, wherein the voice signal is modulated differently by multiplying a different predetermined weighting coefficient according to the gender of the input voice signal by the detected value from the pitch detector.

4. The apparatus according to claim 1, wherein the pitch modulator comprises the memory for storing the predetermined value; and a multiplier for multiplying the predetermined value output from the memory by the detected pitch value output from the pitch detector.

5. The apparatus according to claim 4, wherein the memory stores at least two values for use in varying a signal outputted from the pitch detector.

6. The apparatus according to claim 1, wherein the different predetermined value multiplies is determined according to a desired output voice signal based on the input voice signal.

7. The apparatus according to claim 6, wherein the desired output voice signal is a male voice and the input voice signal is a female voice.

8. The apparatus according to claim 6, wherein the desired output voice signal is a male voice and the input voice signal is a different male voice.

9. The apparatus according to claim 6, wherein the desired output voice signal is a female voice and the input voice signal is a male voice.

10. The apparatus according to claim 6, wherein the desired output voice signal is a female voice and the input voice signal is a different female voice.

11. A voice modulation method, comprising:

analyzing and detecting a voice pitch of an input voice signal;

detecting a gender of the input voice signal by using at least one of a frequency or a pitch period of the input voice signal;

determining whether a voice modulation function is selected;

varying a pitch period of the voice signal and modulating the voice pitch when the voice modulation function is selected by multiplying the detected pitch value from the pitch detector by a predetermined value, wherein the voice signal is modulated differently by multiplying a different predetermined value by the detected pitch value from the pitch detector, wherein the different predetermined value varies according to the detected gender;

coding the input signal; and outputting a coded signal.

12. The method according to claim 11, wherein the predetermined value is selected according to a desired gender modulation.

13. A voice modulation method, comprising:

detecting a gender and a pitch value of an input signal;

multiplying the detected pitch value by a predetermined value for producing a modulated voice value;

converting the modulated voice value and outputting a coded value, wherein detecting gender of the input signal comprises performing gender analysis by using at least one of a frequency or a pitch period of the input signal, and wherein the modulated voice value is produced differently by multiplying the detected pitch value by a different predetermined value according to the detected gender of the input signal.

14. The method according to claim 13, wherein the voice modulation is performed by varying the period of an impulse train of the input signal.

15. The method according to claim 13, wherein the predetermined value is selected according to a desired gender modulation.

16. The method according to claim 13, further comprising:

storing at least two predetermined values related to an input voice and a modulated output voice.

17. The method according to claim 16, wherein the predetermined value for voice modulation is greater when the desired gender is male than when the desired gender is female.

* * * * *